US007614108B2

(12) United States Patent
Wang

(10) Patent No.: US 7,614,108 B2
(45) Date of Patent: Nov. 10, 2009

(54) PAN CLEANER

(76) Inventor: Jianbo Wang, Room1206, 3 Building, Yiqi, Ouzhou Cheng, Wenzhou (CN) 315000

( * ) Notice: Subject to any disclaimer, the term of this patent is extended or adjusted under 35 U.S.C. 154(b) by 0 days.

(21) Appl. No.: 12/053,549

(22) Filed: Mar. 21, 2008

(65) Prior Publication Data

US 2008/0222823 A1 Sep. 18, 2008

Related U.S. Application Data

(63) Continuation of application No. PCT/CN2006/002791, filed on Oct. 20, 2006.

(51) Int. Cl.
*A47L 15/39* (2006.01)

(52) U.S. Cl. ..... 15/74; 15/77; 15/88.1; 15/88.3; 15/101; 15/306.1; 15/102; 15/307; 15/308

(58) Field of Classification Search ..... 15/74, 15/77, 88.1, 88.3, 101, 308, 306.1, 307, 102
See application file for complete search history.

(56) References Cited

U.S. PATENT DOCUMENTS 223,904 A * 1/1880 Mathiessen ..... 198/692
1,772,749 A * 8/1930 Heusser ..... 15/160
1,800,611 A * 4/1931 Eiane ..... 74/580
1,927,917 A * 9/1933 Canfield ..... 15/75
2,153,303 A * 4/1939 Fielding ..... 15/74
2,156,949 A * 5/1939 Klinger ..... 15/74
2,239,047 A * 4/1941 Mathiessen ..... 15/164
2,532,925 A * 12/1950 Loeb ..... 15/74
2,840,838 A * 7/1958 Brown, Jr. ..... 15/74
2,978,718 A * 4/1961 Vani et al. ..... 15/53.4
3,011,192 A * 12/1961 Delamater ..... 15/74
3,075,215 A * 1/1963 Marue ..... 15/77
4,741,783 A * 5/1988 Daunheimer et al. ..... 134/15
2003/0196285 A1 * 10/2003 O ..... 15/88.1

* cited by examiner

*Primary Examiner*—Joseph J Hail, III
*Assistant Examiner*—Robert Scruggs
(74) *Attorney, Agent, or Firm*—Matthias Scholl P.C.; Matthias Scholl

(57) ABSTRACT

Provided is a pan cleaner, comprising a cleaning portion, a brush sweeping portion having a cleaning component and a driving portion; wherein the cleaning portion provides cleaning fluid for a pan, the cleaning component is contacted with an inner surface of the pan, so as to brush the inner surface of the pan, and the driving portion is connected to and drives the brush sweeping portion. The pan cleaner of the invention can effectively remove residues in a pan, and thus decreases labor intensity of a chef and increases hygiene quality.

7 Claims, 15 Drawing Sheets

PAN CLEANER

CROSS-REFERENCE TO RELATED APPLICATIONS

This application claims priority benefits to Chinese Patent Application No. 200510114518.9 filed Oct. 24, 2005, and International Patent Application No. PCT/CN2006/002791 with an international filing date of Oct. 20, 2006. The contents of all of the aforementioned specifications are incorporated herein by reference.

BACKGROUND OF THE INVENTION

1. Field of the Invention

The invention relates to catering equipment, and particularly to a pan cleaner.

2. Description of the Related Art

Conventionally, a pan cleaner employs jet fluid to clean a pan, and the pan rotates along with a shelf at the same time. However, residues in the pan that are produced during a heating process such as boiling, stew, frying, decoction and so on are difficult to be cleaned. In a scenario where a chef is very busy, he usually cleans a pan manually, which increases his labor intensity and decreases hygiene quality.

SUMMARY OF THE INVENTION

In view of the above-described problems, it is one objective of the invention to provide a pan cleaner that can effectively remove residues in a pan, and thus decreases labor intensity of a chef and increases hygiene quality.

To achieve the above objectives, in accordance with one embodiment of the invention, provided is a pan cleaner, comprising a cleaning portion, a brush sweeping portion having a cleaning component and a driving portion; wherein the cleaning portion provides cleaning fluid for a pan, the cleaning component is contacted with an inner surface of the pan, so as to brush the inner surface of the pan, and the driving portion is connected to and drives the brush sweeping portion.

In certain classes of this embodiment, a bottom of the pan is inversely disposed on the brush sweeping portion, and is supported by the cleaning component, and the cleaning fluid provided by the cleaning portion is jet fluid.

In certain classes of this embodiment, the pan cleaner further comprises a cleaning tank disposed at the bottom of the brush sweeping portion for collecting waste liquid.

In certain classes of this embodiment, a through hole is disposed at the bottom of the cleaning tank, and a stand pipe vertically disposed in the through hole.

In certain classes of this embodiment, the driving portion comprises a driving shaft disposed in the stand pipe, a motor disposed at the bottom of the cleaning tank and having an output shaft, a connecting mechanism connecting the driving shaft and the output shaft of the motor, and the driving shaft passes through the through hole, extends upwardly into the cleaning tank; and is connected to the brush sweeping portion.

In certain classes of this embodiment, the connecting mechanism is a gear transmission mechanism, the motor is a variable speed motor, a pair of bevel gears are disposed on the output shaft of the motor and the bottom of the driving shaft, power of the motor is transmitted to the driving shaft via engagement between the bevel gears.

In certain classes of this embodiment, the brush sweeping portion comprises a plurality of brush sweeping components connected to the driving shaft via a connecting component, at least one first brush sweeping portion being rotable, and at least one second brush sweeping portion being non-rotable.

In certain classes of this embodiment, the brush sweeping component has a floating-type brush sweeping unit, comprising a brush sweeping unit mount and at least two floating brush sweeping portions located in a same plane, the floating brush sweeping portions being flexibly connected and hinged to the brush sweeping unit mount, the brush sweeping unit mount is arc-curved, the brush sweeping unit mount has at least two bearing portions respectively supporting the at least two floating brush sweeping portions, a first connecting portion is disposed at one end of one floating brush sweeping portion, the first connecting portion comprising a vertical connecting groove and a horizontal connecting groove, a second connecting portion is disposed at one end of the other floating brush sweeping portion, a pair of horizontal pins extend from both ends of the second connecting portion, the second connecting portion is flexibly connected to the vertical connecting groove in a vertical direction, and the horizontal pin is flexibly connected to the horizontal connecting groove in a horizontal direction.

In certain classes of this embodiment, the first brush sweeping component comprises a supporting shaft rotably disposed on the connecting component and passing therethrough, the floating-type brush sweeping unit hinged at the top of the supporting shaft and capable of rotating with respect to the supporting shaft in a vertical plane, and a gear fixed at the bottom of the supporting shaft, and engaged with another gear disposed on the stand pipe; a first installation portion is disposed on the connecting component and operates to install the first brush sweeping component, a concave is disposed on the first installation portion, and a bearing is disposed in the concave for receiving the supporting shaft.

In certain classes of this embodiment, the second brush sweeping component comprises a supporter having one end pivotally connected to the connecting component, and being capable of swinging in a vertical plane, and the floating-type brush sweeping unit disposed at the other end of the supporter and capable of rotating with respect to the supporter in a vertical plane, a second installation portion for installing the second brush sweeping component is disposed on the connecting component; a pivot connecting portion with a pivot hole and an extension supporting portion with a guide hole are disposed on the second installation portion, a sliding pole is pivotally connected to the supporter of the second installation portion, and is received in the guide hole, a spring is mounted on the sliding pole, and is supported by the extension supporting portion, and the pivot connecting portion is pivotally connected to the supporter of the second brush sweeping component.

In certain classes of this embodiment, the connecting component comprises a supporter pivotally connected to the connecting component, and being capable of swinging in a vertical plane, a supporting shaft rotably disposed on the supporter and passing therethrough, a roller fixedly disposed at the bottom of the supporting shaft, the roller being contacted with a connecting portion on the stand pipe, and capable of rotating around the connecting portion as the driving shaft rotates, so as to drive the supporting shaft to rotate, and a cleaning component being a brush sweeper is disposed at the top of the supporting shaft.

In certain classes of this embodiment, a supporting sleeve is disposed on the supporter, the supporting shaft is disposed in the supporting sleeve via a bearing, an adjusting slot is disposed on the supporter, and extends along an axial direction of the driving shaft, the supporting sleeve is disposed in the adjusting slot, an adjusting screw is disposed at the outside of the supporter, and abuts against the supporting sleeve, a groove is disposed at an outer surface of the supporting sleeve, and an edge at both sides of the adjusting slot is engaged with the groove.

In certain classes of this embodiment, at least one of the connecting portion and the roller has a vertical gear, the roller is made of elastomer, the roller has a convex-arc-shaped vertical section profile, and a top of the supporting shaft is a guide portion.

In certain classes of this embodiment, the brush sweeper comprises a brush mount and a bristle, a guide hole is disposed on the brush mount, the guide hole is slidingly engaged with the guide portion of the supporting shaft, so that the brush sweeper rotates along with the supporting shaft, a spring is mounted on the supporting shaft, the brush sweeper is elastically supported by the spring, and the brush mount is made of flexible material.

In certain classes of this embodiment, the cleaning portion comprises a first water-supply portion and a second water-supply portion, the first water-supply portion and the second water-supply portion are connected to an inlet pipe via a switching valve, the first water-supply portion supplies water, the second water-supply portion supplies cleaning fluid containing cleaning agent, at least one of the first water-supply portion and the second water-supply portion is connected to a pump.

In certain classes of this embodiment, the driving shaft comprises a through hole disposed thereon, the cleaning portion comprises an inlet pipe, the inlet pipe passes through the through hole on the driving shaft and extends into the cleaning tank, a nozzle is disposed at the top of the inlet pipe, and operates to dispersedly spray liquid flow, a waterproof component is disposed at the top of the inlet pipe, a skirt extends downwardly from an edge of the waterproof component, and operates to prevent liquid from over-flowing via the top of the driving shaft, the waterproof component is a base of the nozzle, and the bottom of the skirt is lower than the top of the driving shaft.

In certain classes of this embodiment, the pan cleaner further comprises a body comprising a frame, an enclosure and a top cover.

In certain classes of this embodiment, the body supports the cleaning tank, the top cover covers the cleaning tank, a compacting device is disposed on the top cover, so as to add pressure on the bottom of the pan as the top cover is closed, a positioning groove is disposed at a top edge of the body, and a shank of the pan is disposed in the positioning groove.

In certain classes of this embodiment, the pan cleaner further comprises a controller for controlling operation of the pan cleaner, the controller being a magnetic relay.

Advantages of the invention are as follows.

The pan cleaner has a cleaning component, which is contacted with and brushes an inner surface of the pan, so that residues within the pan can be completely removed. Moreover, use of the cleaning portion provides cleaning fluid to the pan, which further guarantees good cleaning effect.

Two water-supply portion disposed in the cleaning portion provide two types of cleaning liquid flow: water and cleaning fluid containing cleaning agent, which effectively remove residual oil dent in the pan.

The motor of the pan cleaner is a variable speed motor, which makes it convenient to adjust a rotating speed of the brush sweeping portion, so that cleaning time may be adjusted according to the type of the pan to be cleaned, and better cleaning effect is obtained.

The electromagnetic relay of the pan cleaner is capable of controlling working time of the pan cleaner, so that cleaning time may be adjusted according to the type of the pan to be cleaned, and better cleaning effect is obtained.

By way of engagement between the rotable first brush sweeping component and the non-rotable second brush sweeping component, along with the brush sweeping component with the floating-type brush sweeping unit adapting to an inner surface profile of the pan, better cleaning effect is obtained.

The pan cleaner of the invention can effectively remove residues in a pan, and thus decreases labor intensity of a chef and increases hygiene quality.

BRIEF DESCRIPTION OF THE DRAWINGS

The invention will now be described solely by way of example and with reference to the accompanying drawings in which.

DETAILED DESCRIPTION OF THE INVENTION

Detailed description will be given below with reference to accompanying drawings.

Figure 1:
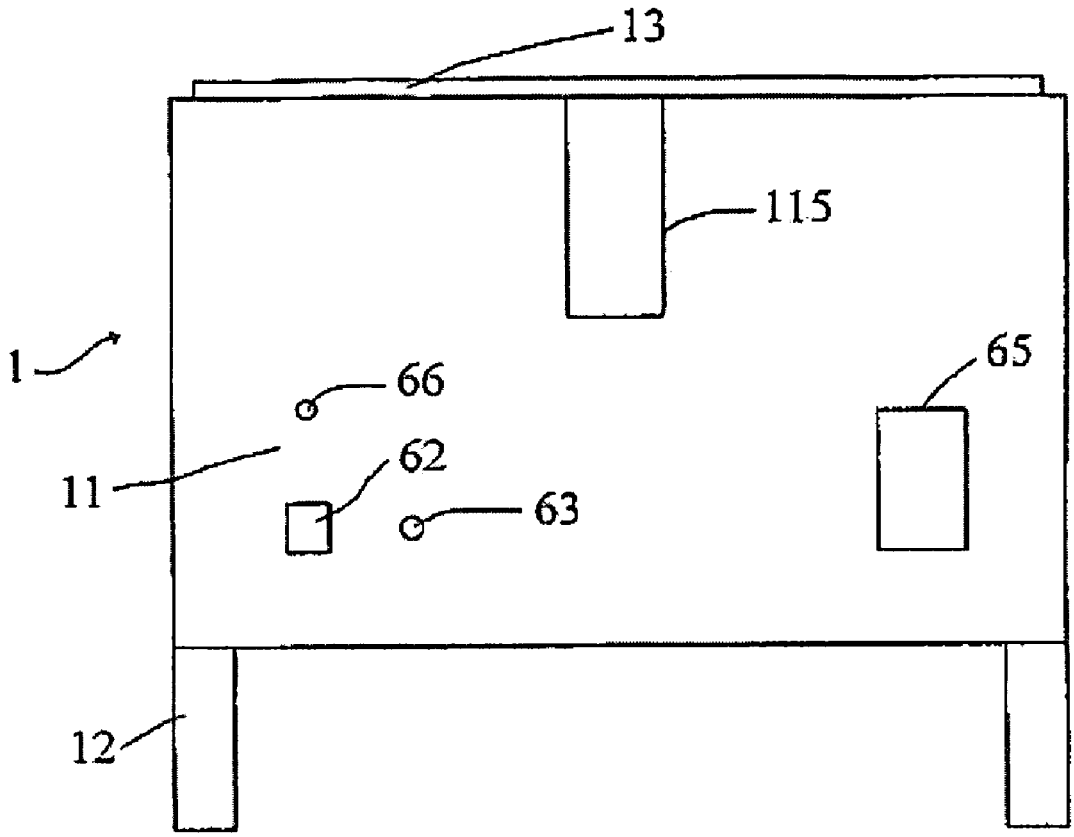
FIG. 1 is a front view of a pan cleaner of the invention.
Figure 2:
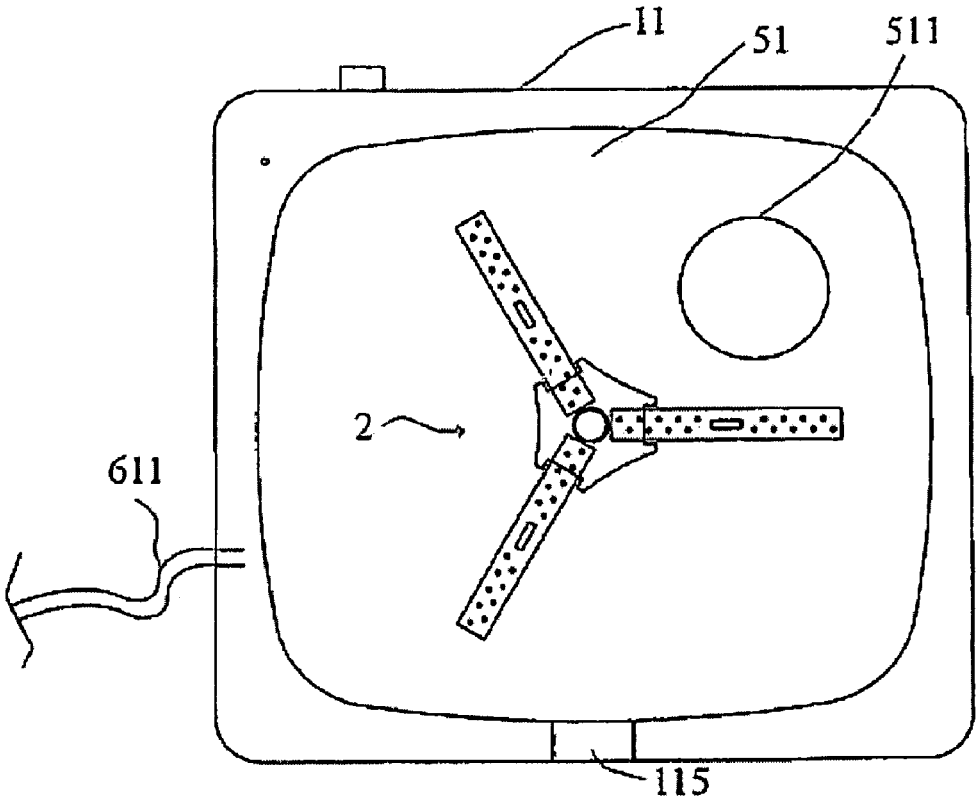
FIG. 2 is a top view of a pan cleaner of FIG. 1.

Referring to FIGS. 1 and 2, a pan cleaner of the invention comprises a body 1, and the body 1 comprises a frame 12, an enclosure 11 and a top cover 13.

Figure 3:
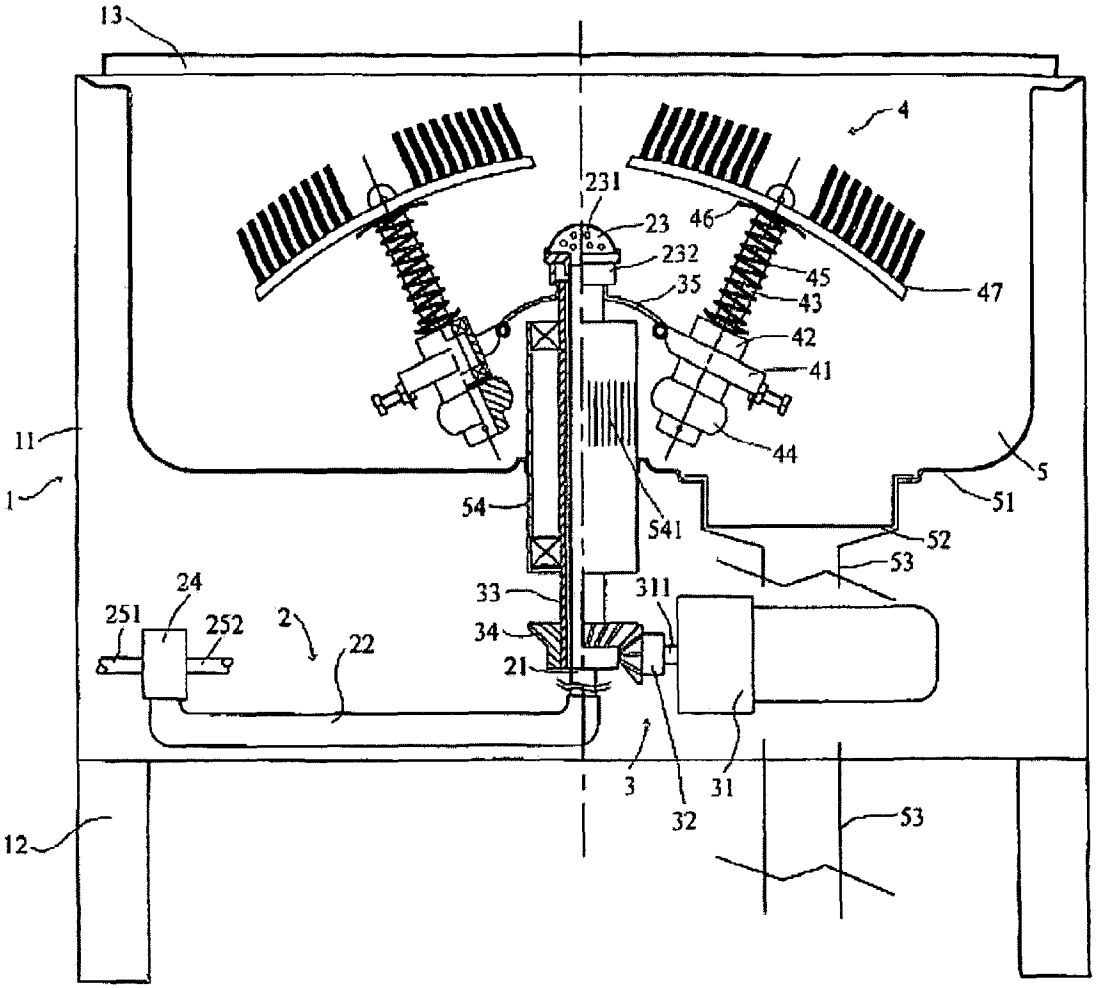
FIG. 3 is a front partial sectional view of a pan cleaner of FIG. 1.

Referring to FIG. 3, the pan cleaner further comprises a cleaning portion 2, a brush sweeping portion 4 and a driving portion 3.

The cleaning portion 2 provides cleaning fluid (such as water, cleaning fluid containing cleaning agent and so on) for a pan (not shown), so as to infiltrate residues within the pan, and to remove and/or brush oil dent therein. A brush sweeper 48 is disposed on the brush sweeping portion 4, as the brush sweeper 47 is contacted with an inner surface of the pan, the inner surface is brushed, and thus residues within the pan is separated from the surface of the pan. The driving portion 3 is connected to the brush sweeping portion 4, so as to drive the brush sweeping portion 4 to operate.

The pan cleaner further comprises a cleaning tank 51 disposed in the enclosure 11 and located at the bottom of the brush sweeping portion 4, so as to collect waste fluid. A through hole is disposed at the center of the bottom of the cleaning tank 51, and a stand pipe 54 is vertically disposed in the through hole via liquid seal, and operates as a supporting mechanism. In this embodiment, the stand pipe 54 is welded to the cleaning tank 51.

Moreover, a circuit is disposed in the pan cleaner, and comprises a controller for controlling the pan cleaning and other components.

In order to obtain good cleaning effect, in this embodiment, the cleaning fluid provided by the cleaning portion 2 is jet fluid, which is capable of flushing an inner part of the pan. Especially, during the use of the pan cleaner, a bottom of the pan is inversely disposed on the brush sweeping portion 4, and is supported by the cleaning component such as the brush sweeper 47. Thus, it is no longer required to manually dump waste cleaning fluid, and the bottom of the pan will not be damped by the fluid, which decreases labor intensity of a chef is decreased, and improves cleaning degree of the pan.

Figure 15:
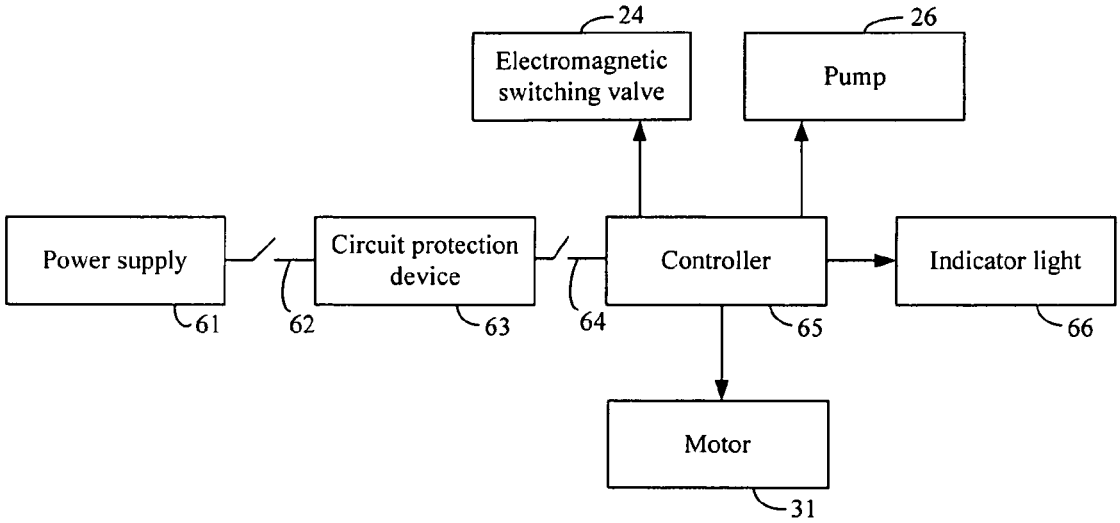
FIG. 15 is a circuit schematic diagram of a pan cleaner of the invention.

As shown in FIG. 3, the cleaning portion 2 comprises a first water-supply portion 251 and a second water-supply portion 252 both connected to a switching valve 25 and then to an inlet pipe 21 via the switching valve 25 and a connecting hose 22. The first water-supply portion 251 supplies water, and the second water-supply portion 242 supplies cleaning fluid containing cleaning agent, the cleaning agent being made by adding detergent to water. The first water-supply portion 251 and the second water-supply portion 252 can both be connected to a pump (as shown in FIG. 15), so as to provide jet fluid with certain pressure. In another embodiment, only the second water-supply portion 252 is connected to the pump. The switching valve 24 is an electromagnetic valve having a plurality of operating states, so as to enable the first water-supply portion 251 or the second water-supply portion 252 to be connected to the connecting hose 22.

The inlet pipe 21 passes through the stand pipe 54 disposed at the center of the cleaning tank 51 and extends upwards to an inner space of the cleaning tank 51. A nozzle 23 is disposed at the top of the inlet pipe 21, and operates to dispersedly spray liquid flow onto an inner surface of the pan. The nozzle 23 comprises an enclose 231 and a base 232. A plurality of holes are disposed on the enclose 231 for spraying liquid flow, and the base 232 fixes the nozzle 23 to the top of the inlet pipe 21.

The driving portion 3 comprises a motor 31, a connecting mechanism and a driving shaft 33.

The motor 31 is disposed at the bottom of the cleaning tank, and has an output shaft 311.

The connecting mechanism connects the output shaft 311 of the motor 31 to the driving shaft 33. The connecting mechanism may be any mechanical connecting mechanism, such as a chain transmission mechanism, a belt transmission mechanism or a gear transmission mechanism. In this embodiment, the connecting mechanism is a gear transmission mechanism, and comprises the output shaft 311 disposed on the motor 31, and a pair of bevel gears 33 and 34 disposed at the bottom of the driving shaft 33. Power of the motor 31 is transmitted to the driving shaft 33 via engagement between the bevel gears 32 and 34. Preferably, the motor 31 is a variable speed motor.

The driving shaft 33 passes through the through hole in the stand pipe 54 along a central axis of the stand pipe 54, extends upwardly into the cleaning tank 51, and is rotably installed in the stand pipe 54 via bearings at both ends of the stand pipe 54. The top of the driving shaft 33 is connected to the brush sweeping portion 4 via the connecting component 35.

A through hole is disposed in the driving shaft 33, and the inlet pipe 21 of the cleaning portion 2 pass through the through hole in the driving shaft 33 and extends into the cleaning tank 51.

To prevent liquid from over-flowing via the top of the driving shaft 33 during the cleaning process, a waterproof component is disposed at the top of the inlet pipe 33. In this embodiment, A loop-shaped skirt extends downwardly from an edge of the nozzle 23, the bottom of the skirt is lower than the top of the driving shaft 33, so as to prevent liquid from over-flowing via the top of the driving shaft.

Figure 4:
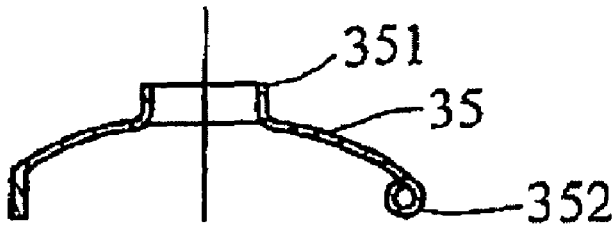
FIG. 4 is a front sectional view of a connecting component of a pan cleaner.
Figure 5:
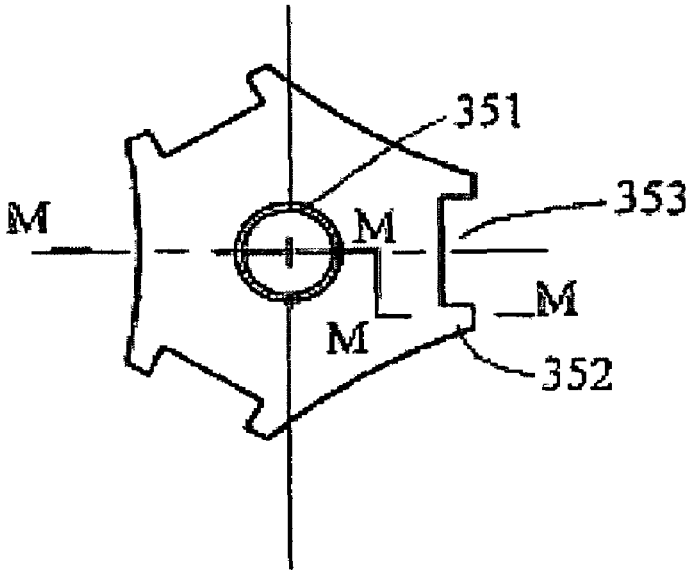
FIG. 5 is a top view of a connecting component of FIG. 4.

As shown in FIGS. 4 and 5, the umbrella-shaped connecting component 35 is fixed at the top of the driving shaft 33, and covers the top of the stand pipe 54, so as to prevent splashing liquid from entering the top of the stand pipe 54. A plurality of pivot connecting portions 352 are disposed in the vicinity of the connecting component 35, and a pivot hole is formed on each of the pivot connecting portions 352, and is connected to the brush sweeping portion 4 via a pin. A tab 353 in an axial direction is disposed at the center of the pivot connecting portions 352, and extends outwards.

The brush sweeping portion 4 comprises a plurality of brush sweeping components, and each brush sweeping component being connected to the top of the driving shaft 33 of the driving portion 3. The brush sweeping component comprises a supporter 41, a supporting sleeve 42, a supporting shaft 43, a roller 44, an arc-shaped washer 46, a spring 45 and a brush sweeper 47.

Figure 6:
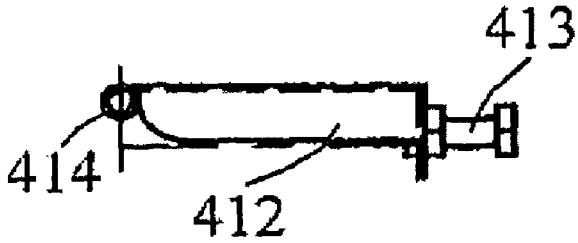
FIG. 6 is a front view of a supporter of a brush sweeping component of a pan cleaner.
Figure 7:
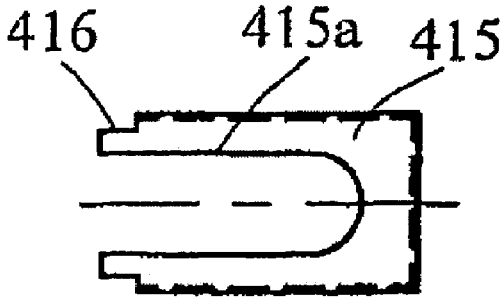
FIG. 7 is a top view of a supporter of FIG. 6.
Figure 8:
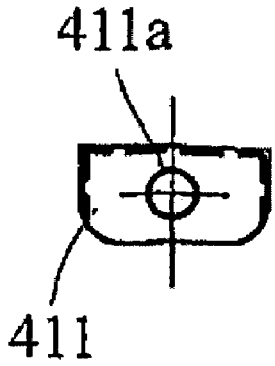
FIG. 8 is a right side view of a supporter of FIG. 6.

Referring to FIGS. 6-8, the supporter 41 is pivotally connected to the connecting component 35, and capable of swinging up and down in a vertical plane of the driving shaft 33. The supporter 41 is enclosed by a top wall 415, two opposite side walls 412 and an end wall 411. An adjusting slot 415*a* for receiving the supporting sleeve 42 is disposed on the top wall 415, extends along an axial direction of the driving shaft 33, and faces inwards. The end wall 411 is located at an outer side of the supporter 41 opposite to the central axis. A hole 411 *a* is disposed on the end wall 411 for installing an adjusting screw 413. The adjusting screw 413 abuts against a side wall of the supporting sleeve 42, so as to adjust an axial position of the supporting sleeve 42 with respect to the central axis. By adjusting a position of the supporting sleeve 42 of a brush sweeping component, a brush sweeping range of the brush sweeper 47 may be changed. The top wall 415 extends inwards along an axial direction to form a pivot connecting portion 414. The pivot connecting portion 414 is connected to another pivot connecting portion 352 of the connecting component 35. Both sides 416 of the pivot connecting portion 414 are engaged with the tab 353 of the connecting component 35, and a distance between the two sides 416 is less than a width of the top wall 415. The supporter 41 is made by curving a metal plate, and the side wall 412 operates to enforce strength of the supporter 41.

Figure 9:
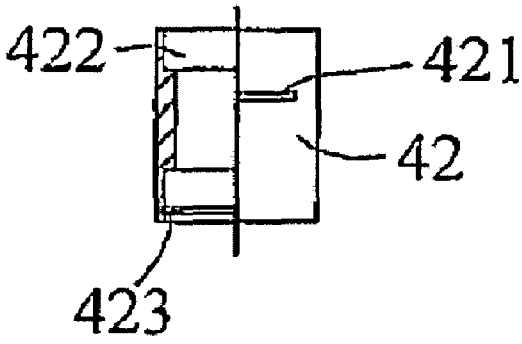
FIG. 9 is a front partial sectional view of a supporting sleeve of a brush sweeping component of a pan cleaner.

Referring to FIG. 9, a pair of grooves 421 are disposed at an outer surface of the supporting sleeve 42, and operate to receive both sides of the adjusting slot 415*a* of the supporter 41, so as to install the supporting sleeve 42 on the supporter 41. The grooves 421 are two straight channels, and may be a loop groove surrounding an outer surface of the supporting sleeve 42. An upper end and a lower end of an inner surface of the supporting sleeve 42 respectively has a spigot 422 for receiving a bearing, and another loop groove is disposed on an inner surface of the lower spigot 422, so as to receive a positioning stopper ring 423.

Figure 10:
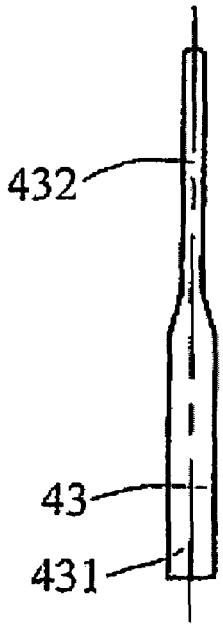
FIG. 10 is a left side view of a supporting shaft of a brush sweeping component of a pan cleaner.
Figure 11:
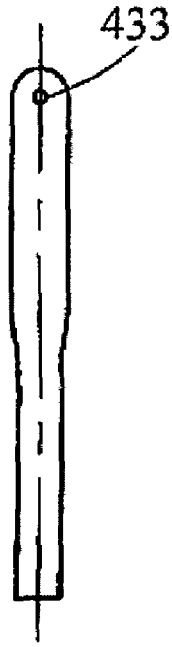
FIG. 11 is a front view of a supporting shaft of FIG. 10.
Figure 12:
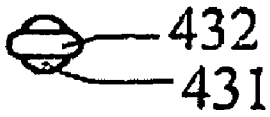
FIG. 12 is a top view of a supporting shaft of FIG. 11.

Referring to FIGS. 10-12, the supporter 43 is rotably received in the supporting sleeve 42 via a bearing, installed on the supporter 41 via the supporting sleeve 42, and then passes through the supporter 41. A pivotal portion 431 is disposed at the bottom of the supporting shaft 43, and a guide portion 432 is disposed at the top thereof. A cross section of the guide portion 432 is rectangular.

In this embodiment, since the guide portion is made by forging or calendaring columnar bar via forging process, both ends of the rectangular cross section is arc-shaped. It should be understood that the rectangular cross section may not employ the arc-shaped structure. Alternatively, the cross section of the guide portion may be any other shapes suitable for implementing circumference orientation.

A hole 433 is disposed at the top of the supporting shaft 43, and operates to receive a split pin, so as to prevent the brush sweeper 47 on the guide portion 432 from sliding off the supporting shaft 43.

The roller 44 is fixed at the bottom of the supporting shaft 43, and contacted with the connecting portion 541 on the stand pipe 54 as the supporter 41 swings downwards. As the driving shaft 33 rotates with respect to the stand pipe 54, the roller 44 rotates along the connecting portion 541 drives the supporting shaft 43 to rotate, and enables the brush sweeper 47 to rotate with respect to the inner surface of the pan and remove residues on the pan. In this embodiment, the connecting portion 541 is a vertical insection. Preferably, insections may also be disposed on the surface of the roller 44, so as to ensure the roller 44 rolls along the connecting portion 541. In other embodiments, the roller 44 may be made of elastomer, so as to improve connection effect between the roller 44 and the connecting portion 541. Alternatively, the roller 44 may be a gear engaged with another gear on the stand pipe 54. Advantageously, the roller 44 has a convex-arc-shaped vertical section profile, so that in different scenarios (such as where a position of the supporting sleeve 42 is adjusted via the screw 413, and the brush sweeper axially moves with respect to the central axis), the roller 44 is still capable of being reliably connected to the connecting portion 541.

Figure 13:
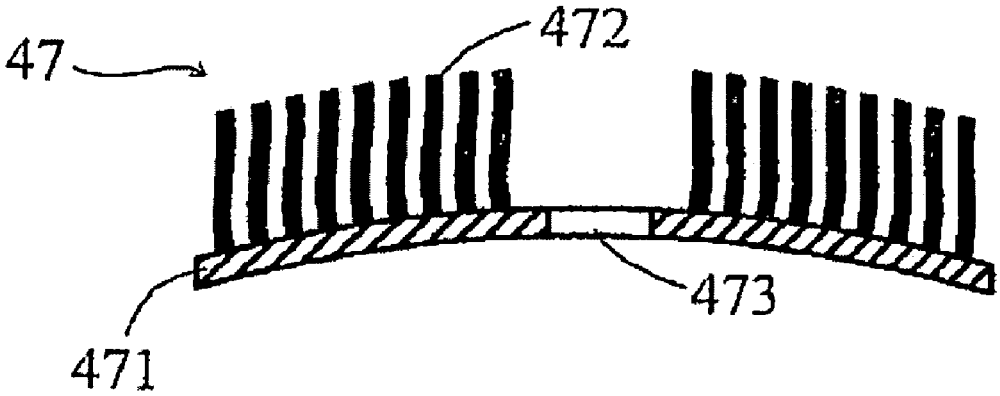
FIG. 13 is a front sectional view of a brush sweeper of a brush sweeping component of a pan cleaner.
Figure 14:
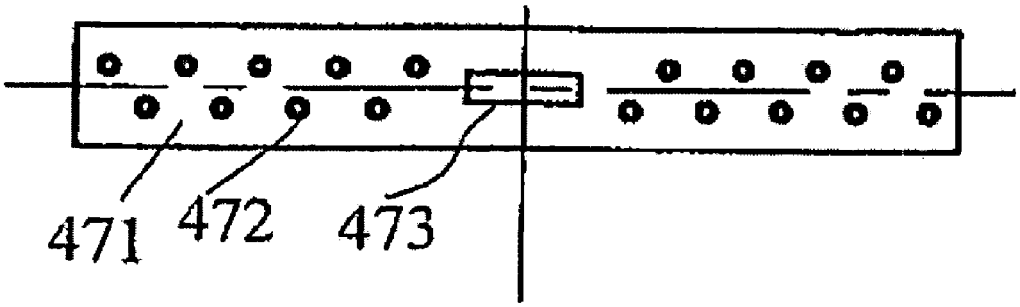
FIG. 14 is a top view of a brush sweeper of FIG. 13.

As shown in FIGS. 13 and 14, the brush sweeper 47 is dispose at the top of the supporting shaft 43, and comprises a brush mount 471 and a bristle 472. A guide hole 473 engaged with the guide portion 432 of the supporting shaft 43 is disposed on the brush mount 471, so that the brush sweeper 47 is capable of sliding up and down along the guide portion 432 and rotating along with the supporting shaft 43. Preferably, the brush mount 471 is made of deformative flexible material such as rubber, so that the bristle 472 may better adapt to a profile curve of the inner surface of the pan.

A spring 45 is mounted on the supporting shaft, and a pair of arc-shaped washer 46 are disposed at both sides of the spring 45. By way of the spring 45 elastically supporting the brush sweeper 47, the brush sweeper 47 may adapt to different types of pans, and there exists a contact pressure between the bristle 472 and the inner surface of the pan.

The cleaning tank 51 collects waste fluid generated during the cleaning process of the pan. As shown in FIGS. 2 and 3, the cleaning tank 51 has an outlet hole 511, and a discharge pipe 53 is connected to the bottom of the outlet hole 511, so as to emit waste liquid to the outside of the pan cleaner. To prevent residues from blocking the discharge pipe 53 and sewage pipes thereafter, a filtering component 52 is disposed in the outlet hole 511. The filtering component 52 is disposed on the edge of the outlet hole 511 via a flange in the vicinity of the filtering component 52, and can be directly taken down. The cleaning tank 51, the filtering component 52 and the discharge pipe 53 form a discharge portion 5.

Referring to FIG. 3, the cleaning tank 51 is supported by the body 1, and is disposed in the enclosure 11. The top cover 13 is hinged to the body 1, and may cover the cleaning tank 51 during an operation state. Preferably, a compacting device (not shown) is disposed on the top cover 13, so as to add pressure on the bottom of the pan as the top cover 13 is closed, to increase contact pressure between the inner surface of the pan and the bristle 472 of the brush sweeper 47, and to improve cleaning effect. In this embodiment, a positioning groove 115 is disposed at a top edge of the body. During the cleaning process of a pan with a shank, the shank of the pan may be disposed in the positioning groove 115, so as to prevent a danger situation where it is impossible to place the pan into the cleaning tank as the shank of the pan is too long. A shape, a position and the number of the positioning grooves 113 may be designed according to a type of the pan.

Figure 16:
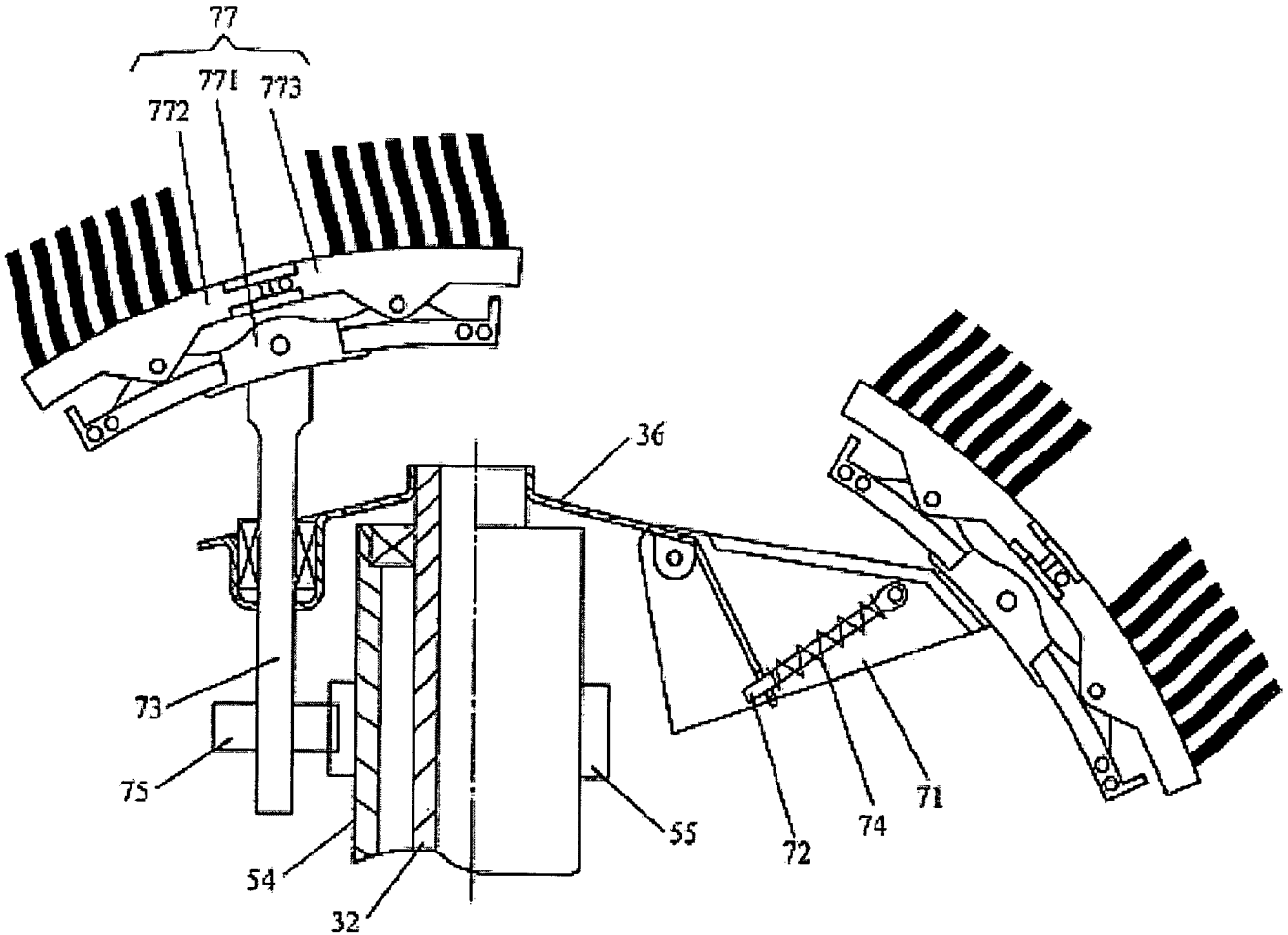
FIG. 16 is a front sectional view of a brush sweeping portion of a pan cleaner of another embodiment of the invention.

As shown in FIG. 16, a brush sweeping portion of a pan cleaner of another embodiment of the invention is shown. It should be noted that components having no relationship with the brush sweeping portion are not shown for simplicity.

As shown FIGS. 17-29, a brush sweeping portion in this embodiment provides a floating-type brush sweeping unit, a brush sweeper thereof comprises a plurality of brush sweeping components flexibly connected in succession, so as to adapt to an inner surface profile of the pan, and to obtain better cleaning effect of the pan.

Referring to FIG. 16, the brush sweeping portion comprises two first brush sweeping components (left brush sweeping portions as shown) being rotable and four second brush sweeping components (right brush sweeping portions as shown) being non-rotable. Each of the brush sweeping components are connected to the top of the driving shaft 33 in the stand pipe 54 via the connecting component 36.

Figure 17:
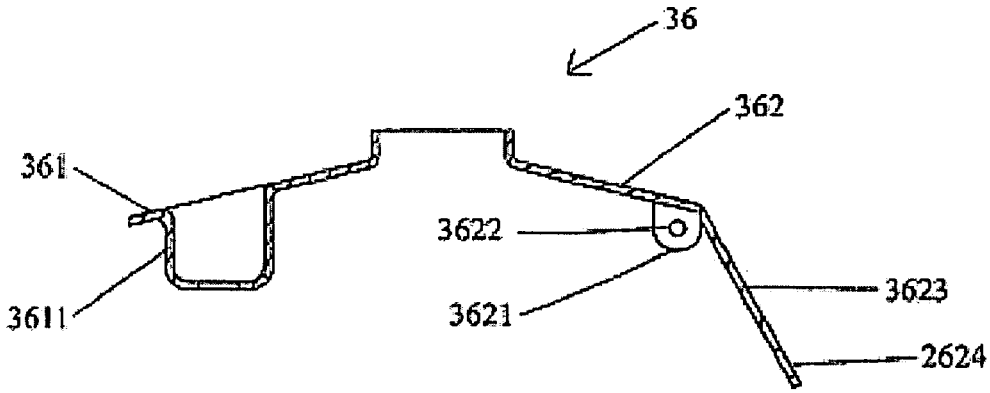
FIGS. 17 and 18 are respectively a front sectional view and a top view of a connecting component of FIG. 16.
Figure 18:
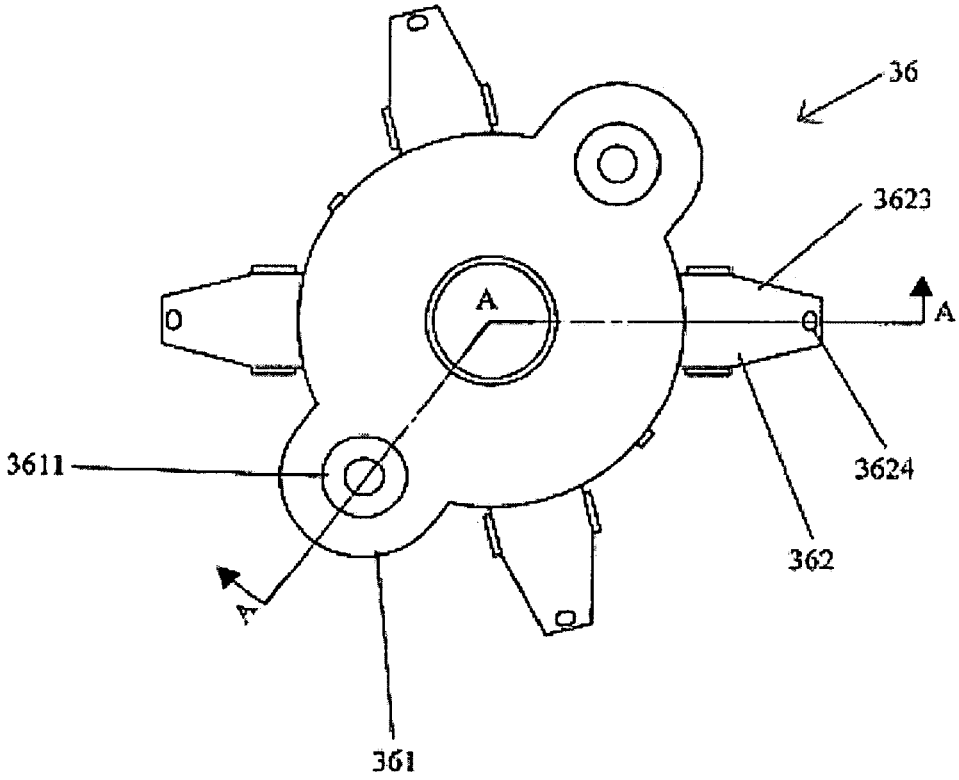

Referring to FIGS. 17 and 18, the connecting component 36 is approximately disc-shaped, and an installation hole is disposed at the center thereof, and is fixed to the top of the driving shaft 33. Two opposite first installation portions 361 for installing the first brush sweeping component and four second installation portions 362 for installing the second brush sweeping component are disposed at an outer edge of the connecting component 36.

A concave 3611 is disposed on the first installation part, and a bearing (referring to FIG. 16) is disposed in the concave 3611, so as to install the supporting shaft 73 of the first brush sweeping component. A through hole is disposed at the bottom of the concave 3611, so as to allow the supporting shaft 73 to pass through.

The second installation portion 362 comprises two pivot connecting portions 3621 and an extension supporting portion 3623. The pivot connecting portions 3621 are located at both sides of the second installation portion 362 and extend downwards, and a pivot hole 3622 is disposed on the pivot connecting portion 3621. The extension supporting portion 3623 is located at the center of the second installation portion 362 and extends outwards and downwards in an axial direction, and a guide hole 3624 is disposed in the extension supporting portion 3623. The supporter 71 of the second brush sweeping component is pivotally disposed on the second installation portion 362.

After the first brush sweeping component and the second brush sweeping component are installed on the first installation portion 361 and the second installation portion 362, as the driving shaft 33 rotates, the connecting component 36 rotates along with the driving shaft 33, and drives the first brush sweeping component and the second brush sweeping component to rotate, and thus a cleaning process of the pan is implemented.

Referring to FIG. 16, the first brush sweeping component comprises a supporting shaft 73 rotably installed on the first installation portion 361 of the connecting component 36 and passing though the connecting component 36, a floating-type brush sweeping unit 77 hinged at the top of the supporting shaft 73 and being capable of swinging in a vertical plane of the central axis (a common axis of the stand pipe 54 and the driving shaft 33), and a gear 75 disposed at the bottom of the supporting shaft 73 and engaged with another gear 55 mounted on the stand pipe 54. Alternatively, then gear 75 may be replaced by the roller 44 describe in a former embodiment, and a connecting portion 541 having a vertical insection is disposed at the outer surface of the stand pipe 54.

The floating-type brush sweeping unit 77 comprises a brush sweeping unit mount 771, and a first floating brush sweeping portion 772 and a second floating brush sweeping portion 772 located in a same plane, flexibly connected with each other and hinged to the brush sweeping unit mount 771. Although in this embodiment, the floating-type brush sweeping unit comprises two floating brush sweeping portions, it should be understood that the number is not limited to this, more floating brush sweeping portions may be used as required.

Figure 19:
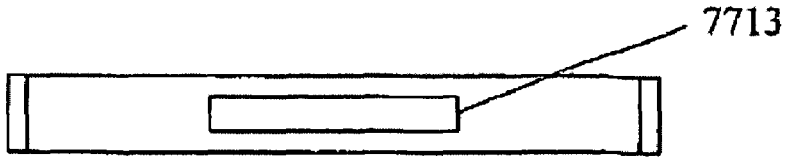
FIGS. 19-21 are respectively a bottom view, a front view and a top view of a brush sweeping unit mount of FIG. 16.
Figure 20:
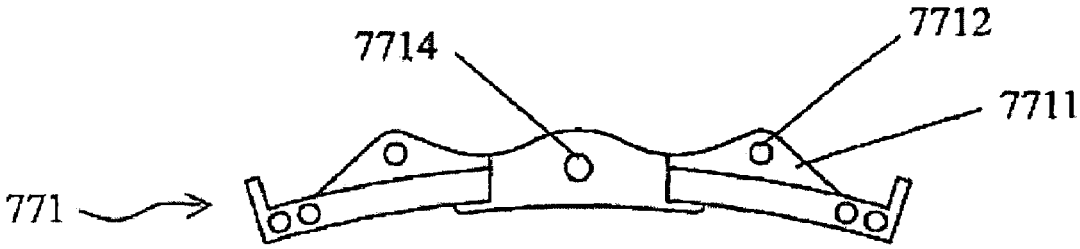
Figure 21:
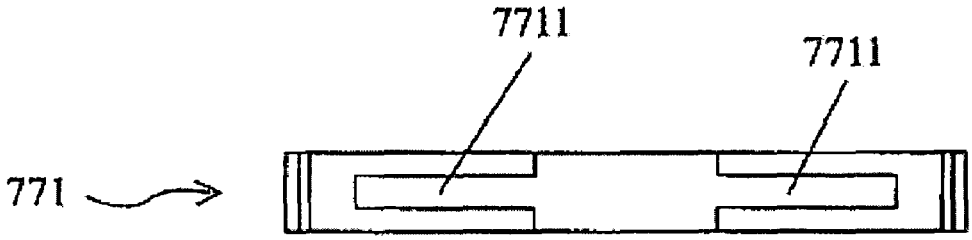

Referring to FIGS. 19-21, the brush sweeping unit mount 771 is arc-curved, and two triangular bearings 7711 are disposed at an upper surface thereof. A pair of pivot hole 7712 are disposed on the bearing 7711, and operate to support and be connected to the first floating brush sweeping portion 772 and the second floating brush sweeping portion 773. A groove 7713 is disposed at the bottom of the brush sweeping unit mount 771, and operate to be engaged and connected with a flat portion 732 at the top of the supporting shaft 73.

Figure 22:
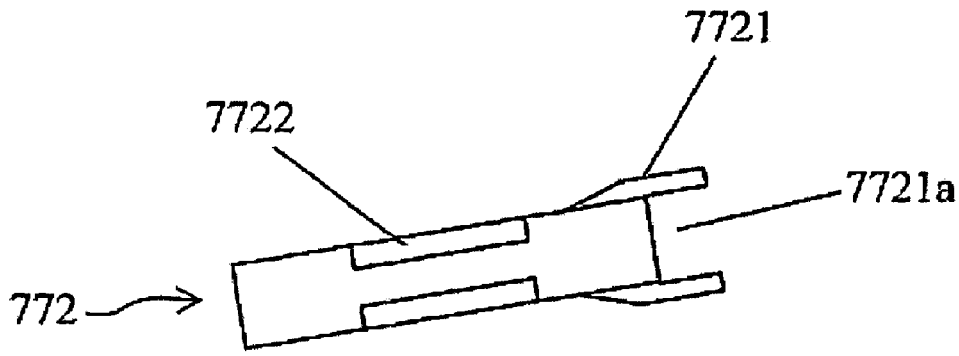
FIGS. 22 and 23 are respectively a bottom view and a front view of a first brush sweeping portion of FIG. 16.
Figure 23:
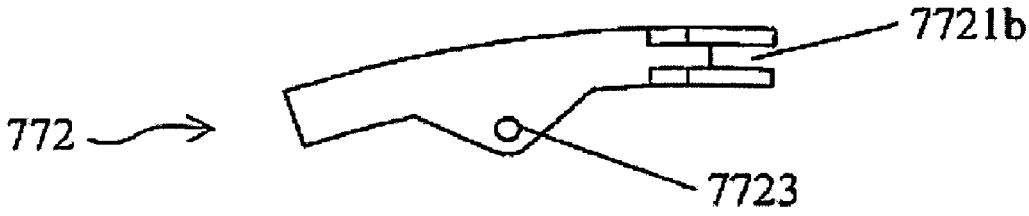
Figure 24:
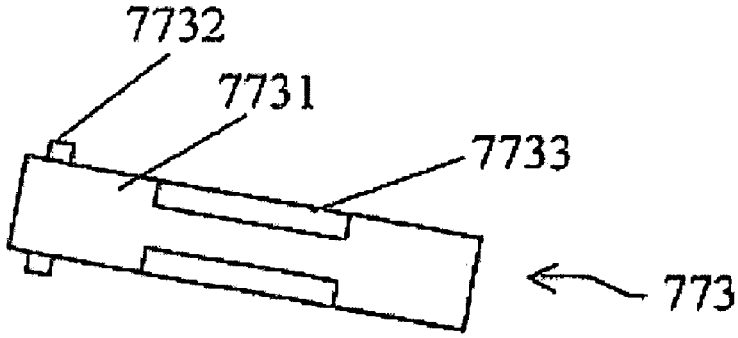
FIGS. 24 and 25 are respectively a bottom view and a front view of a second brush sweeping portion of FIG. 16.
Figure 25:
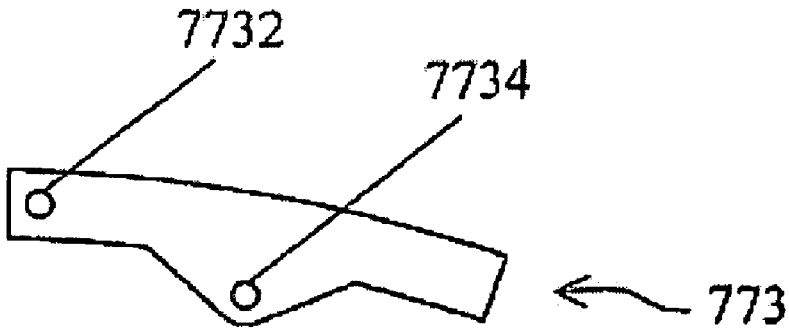

Referring to FIGS. 22-23, a hinge portion 7722 is disposed at the bottom of the first floating brush sweeping portion 772, and a pivot hole 7723 is disposed on the hinge portion 7722. The hinge portion 7722 and the pivot hole 7723 are respectively engaged with the bearing 7711 and the pivot hole 7712 on the brush sweeping unit mount 771. A first connecting portion 7721 is disposed at the right side of the first floating brush sweeping portion 772, and a vertical connecting groove 7721*a* and a horizontal connecting groove 7721*b* are disposed in the first connecting portion 7721. A second connecting portion 7731 is disposed at the left side of the second floating brush sweeping portion 773, and a pair of horizontal pins are disposed at both sides of the second connecting portion 7731. The second connecting portion 7731 is flexibly connected to the vertical connecting groove 7721*a* in a vertical direction, and the horizontal pin 7732 is flexibly connected to the horizontal connecting groove 7721*b* in a horizontal direction.

During a cleaning process of different pans, since the first floating brush sweeping portion 772 and the second floating brush sweeping portion 773 are flexibly hinged to the brush sweeping unit mount 771, relative position therebetween changes according to the inner surface profile of the pan, which facilitates better cleaning effect.

Figure 26:
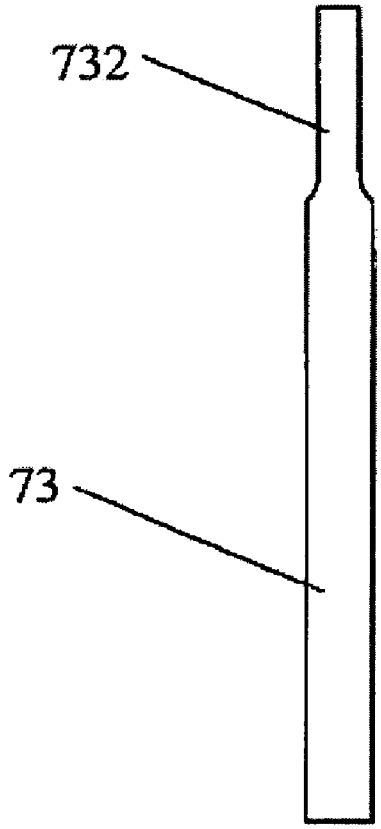
FIGS. 26 and 27 are respectively a left side view and a front view of a supporting shaft of FIG. 16.
Figure 27:
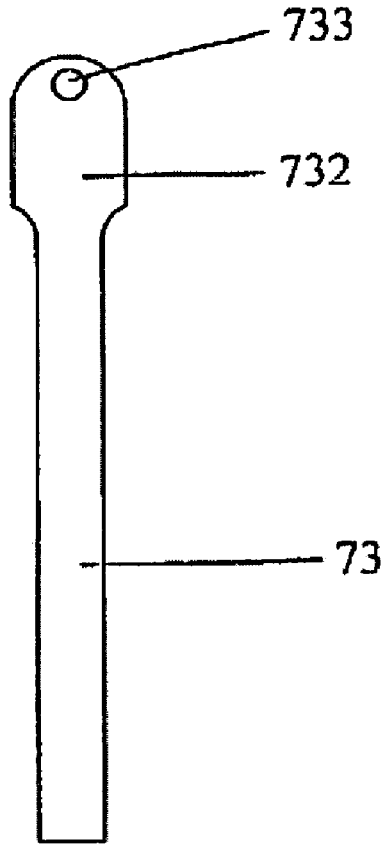

Referring to FIGS. 26-27, a flat portion 732 is disposed at the top of the supporting shaft 73, and a pivot hole 733 is disposed on the flat portion 732. The pivot hole 733 and the pivot hole 7723 implement flexible hinge between the floating brush sweeping unit 77 and the supporting shaft 73 via the pin.

Referring to FIG. 16, the second brush sweeping component comprises a supporter having an end pivotally connected to the second installation portion 361 of the connecting component 36 and capable of swinging in a vertical plane, a floating-type brush sweeping unit 77 disposed at the other end of the supporter 71 and capable of swinging along with the supporter 71 in a plane of the central axis. The floating-type brush sweeping unit 77 is the same as the floating-type brush sweeping unit 77 in the first brush sweeping component.

Figure 28:
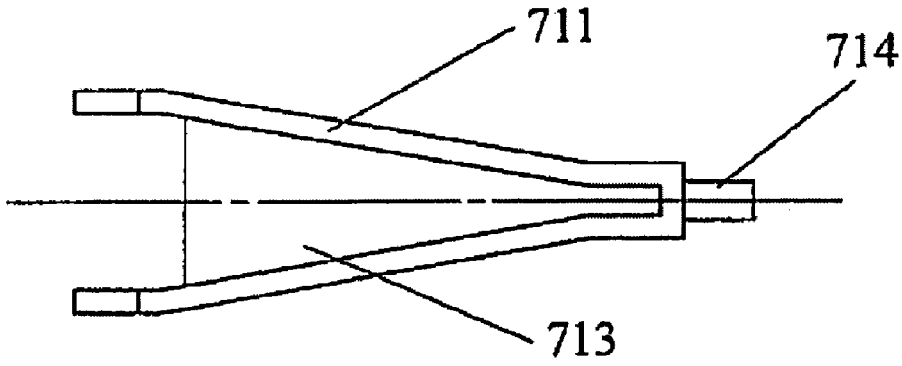
FIGS. 28 and 29 are respectively a bottom view and a front view of a supporter of FIG. 16.
Figure 29:
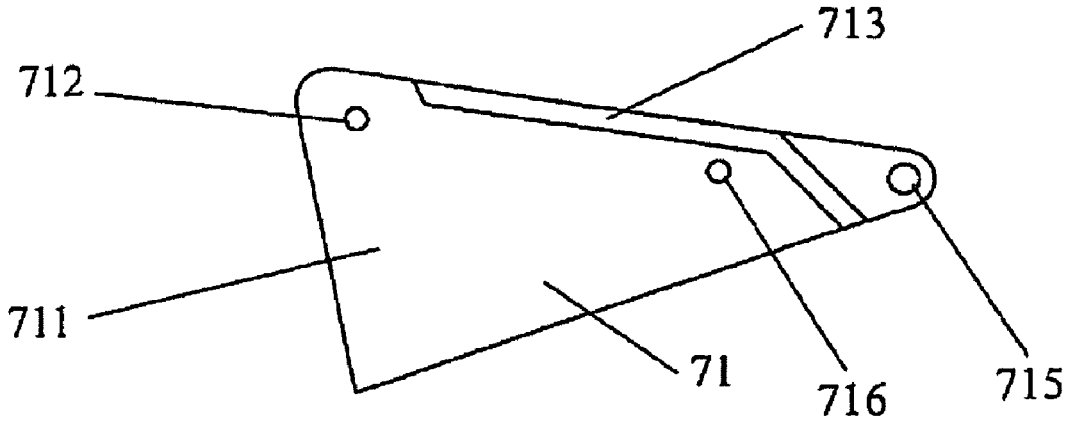

Referring to FIGS. 28 and 29, the supporter 71 of the second brush sweeping component comprises a pair of standing plates 711 at both sides thereof, an intermediate plate 713 disposed between the standing plates 711, and a hinge portion 714 protruding from the front of the intermediate plate 713. A pivot hole 715 is disposed on the hinge portion 714, another pivot hole 716 is disposed on the standing plate 711 of the supporter 71, and a sliding pole 72 is disposed at the bottom of the intermediate plate 713. A pivot hole 712 is disposed in a position where the standing plate 711 and the connecting component 36 are pivotally connected.

Referring to FIG. 16, a spring 74 is mounted on the sliding pole 72, a bottom of the sliding pole 72 passes through the guide hole 3624 of the connecting component 36, and a bottom of the spring abuts against the extension supporting portion 3623 of the connecting component 36. The pivotal connecting portion 3621 of the second installation portion 362 is engaged with an inner side of the standing plate 711 of the second brush sweeping component. By way of disposing a pin in the pivot hole 3622 and the pivot hole 712, the second brush sweeping component is pivotally connected to the connecting component 36.

As the driving shaft 33 rotates, the second brush sweeping component rotates along with the connecting component 36. The spring 74 supports the supporter 71, so as to enable the floating brush sweeping unit 77 on the supporter 71 to be contacted with the inner surface profile of the pan.

By way of engagement between the rotable first brush sweeping component and the non-rotable second brush sweeping component, along with the brush sweeping component with the floating-type brush sweeping unit adapting to an inner surface profile of the pan, the pan cleaner of the invention is capable of obtaining better cleaning effect.

Referring to FIG. 15, a power supply 61 supplies power (current) to the pan via a power line 611 (as shown in FIG. 2). Current flows through a power switch 62, a circuit protection device 63 and a starting switch 64, and is connected to a controller 66. The circuit protection device 63 may be a fuse. The starting switch 64 may be disposed at the bottom of the cleaning tank 51, and is operated by an extended switch lever. The controller 65 connected to an electromagnetic switching valve 24, a pump 26, an indicator light 66 and a motor 31 controls operation of all these components, so as to control operation of the pan cleaner. For example, the controller 65 may be a programmable controller, a microcomputer and so on. A control technique known in the art is used to control the pan cleaner to operate in different operation modes. Alternatively, a detecting device may be added to provide different working conditions for the controller 65, so that working parameters of all components of the pan cleaner may be controlled based on these working conditions, and the pan may be well cleaned. In this embodiment, the controller 65 is an electromagnetic (timing) relay for controlling working time of the pan cleaner.

During operation of the pan cleaner, the top cover 13 is opened, the bottom of the pan is inversely covered on three brush sweepers 47, the shank of the pan is placed into the positioning groove 115, and then the top cover 13 is closed.

Pressure at the inner surface of the pan causes the bristle 472 of the brush sweeper 47 to bend towards surroundings, so as to be fully contacted with the edge of the pan. After the staring switch 64 is enabled, the timing relay operates regularly. Under the control of the timing relay, the pump 26 operates and provides pressured liquid flow. The electromagnetic switching valve 24 is powered on and is switched to a spaying state, the variable speed motor 31 operates and enables the driving portion 3 to drive the brush sweeping portion to operate, so as to switch on the indicator light 66 to indicate an operating state. As the cleaning portion provides cleaning fluid to the pan, the pan does not move, and the connecting component 35 drives all brush sweeping components to rotate around the central axis of the driving shaft 54. Meanwhile, since the roller 44 rolls on the connecting portion 541 of the stand pipe 54, the supporting shaft 43 and the brush sweeper 47 of the brush sweeping component rotate around an axis of the supporting shaft 43, so that the bristle 472 is fully contacted with and moves with respect to the inner surface of the pan to implement the cleaning process. After the periodic operation is over, the timing relay controls all relevant components to stop working, and the cleaning process is completed.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A pan cleaner, comprising:

a cleaning portion;

a brush sweeping portion having a cleaning component;

a driving portion;

a cleaning tank;

a through hole; and a stand pipe;

wherein said driving portion comprises: a driving shaft disposed in said stand pipe; a motor disposed at the bottom of said cleaning tank and having an output shaft; and a connecting mechanism connecting said driving shaft and said output shaft of said motor;

said driving shaft passes through said through hole, extends upwardly into said cleaning tank; and is connected to said brush sweeping portion;

said brush sweeping portion comprises: a plurality of brush sweeping components; at least one first brush sweeping component being rotable and connected to said driving shaft via a connecting component; and at least one second brush sweeping portion being non-rotable;

said cleaning portion provides cleaning fluid for a pan;

said cleaning component is contacted with an inner surface of said pan, so as to brush said inner surface of said pan;

said driving portion is connected to and drives said brush sweeping portion;

a bottom of said pan is inversely disposed on said brush sweeping portion, and is supported by said cleaning component;

said cleaning tank is disposed at the bottom of said brush sweeping portion for collecting waste liquid;

said through hole is disposed at the bottom of said cleaning tank;

said stand pipe is vertically disposed in said through hole;

said first brush sweeping component comprises:

a supporting shaft rotably disposed on said connecting component and passing therethrough;

said floating-type brush sweeping unit hinged at the top of said supporting shaft and capable of rotating with respect to said supporting shaft in a vertical plane; and a gear fixed at the bottom of said supporting shaft, and engaged with another gear disposed on said stand pipe;

a first installation portion is disposed on said connecting component and operates to install said first brush sweeping component;

a concave is disposed on said first installation portion; and a bearing is disposed in said concave for receiving said supporting shaft.

2. The pan cleaner of claim 1, wherein said brush sweeping component has a floating-type brush sweeping unit, comprising a brush sweeping unit mount and at least two floating brush sweeping portions located in a same plane, said floating brush sweeping portions being flexibly connected and hinged to said brush sweeping unit mount;

said brush sweeping unit mount is arc-curved;

said brush sweeping unit mount has at least two bearing portions respectively supporting said at least two floating brush sweeping portions;

a first connecting portion is disposed at one end of one floating brush sweeping portion, said first connecting portion comprising a vertical connecting groove and a horizontal connecting groove;

a second connecting portion is disposed at one end of the other floating brush sweeping portion, a pair of horizontal pins extend from both ends of said second connecting portion;

said second connecting portion is flexibly connected to said vertical connecting groove in a vertical direction; and said horizontal pin is flexibly connected to said horizontal connecting groove in a horizontal direction.

3. A pan cleaner, comprising:

a cleaning portion;

a brush sweeping portion having a cleaning component;

a driving portion;

a cleaning tank;

a through hole; and a stand pipe;

wherein said driving portion comprises: a driving shaft disposed in said stand pipe; a motor disposed at the bottom of said cleaning tank and having an output shaft; and a connecting mechanism connecting said driving shaft and said output shaft of said motor;

said driving shaft passes through said through hole, extends upwardly into said cleaning tank; and is connected to said brush sweeping portion;

said brush sweeping portion comprises: a plurality of brush sweeping components; at least one first brush sweeping component being rotable and connected to said driving shaft via a connecting component; and at least one second brush sweeping portion being non-rotable;

said cleaning portion provides cleaning fluid for a pan;

said cleaning component is contacted with an inner surface of said pan, so as to brush said inner surface of said pan;

said driving portion is connected to and drives said brush sweeping portion;

a bottom of said pan is inversely disposed on said brush sweeping portion, and is supported by said cleaning component;

said cleaning tank is disposed at the bottom of said brush sweeping portion for collecting waste liquid;

said through hole is disposed at the bottom of said cleaning tank;

said stand pipe is vertically disposed in said through hole;

said second brush sweeping component comprises:

a supporter having one end pivotally connected to said connecting component, and being capable of swinging in a vertical plane; and said floating-type brush sweeping unit disposed at the other end of said supporter and capable of rotating with respect to said supporter in a vertical plane;

a second installation portion for installing said second brush sweeping component is disposed on said connecting component;

a pivot connecting portion with a pivot hole and an extension supporting portion with a guide hole are disposed on said second installation portion;

a sliding pole is pivotally connected to said supporter of said second installation portion, and is received in said guide hole;

a spring is mounted on said sliding pole, and is supported by said extension supporting portion; and said pivot connecting portion is pivotally connected to said supporter of said second brush sweeping component.

4. A pan cleaner, comprising:

a cleaning portion;

a brush sweeping portion having a cleaning component;

a driving portion;

a cleaning tank;

a through hole; and a stand pipe;

wherein said driving portion comprises: a driving shaft disposed in said stand pipe; a motor disposed at the bottom of said cleaning tank and having an output shaft; and a connecting mechanism connecting said driving shaft and said output shaft of said said driving shaft passes through said through hole, extends upwardly into said cleaning tank; and is connected to said brush sweeping portion;

said brush sweeping portion comprises: a plurality of brush sweeping components; at least one first brush sweeping component being rotable and connected to said driving shaft via a connecting component; and at least one second brush sweeping portion being non-rotable;

said cleaning portion provides cleaning fluid for a pan;

said cleaning component is contacted with an inner surface of said pan, so as to brush said inner surface of said pan;

said driving portion is connected to and drives said brush sweeping portion;

a bottom of said pan is inversely disposed on said brush sweeping portion, and is supported by said cleaning component;

said cleaning tank is disposed at the bottom of said brush sweeping portion for collecting waste liquid;

said through hole is disposed at the bottom of said cleaning tank;

said stand pipe is vertically disposed in said through hole;

said connecting component comprises: a supporter pivotally connected to said connecting component, and being capable of swinging in a vertical plane; a supporting shaft rotably disposed on said supporter and passing therethrough; a roller fixedly disposed at the bottom of said supporting shaft, said roller being contacted with a connecting portion on said stand pipe, and capable of rotating around said connecting portion as said driving shaft rotates, so as to drive said supporting shaft to rotate; and a cleaning component being a brush sweeper is disposed at the top of said supporting shaft.

5. The pan cleaner of claim 4, wherein a supporting sleeve is disposed on said supporter;

said supporting shaft is disposed in said supporting sleeve via a bearing;

an adjusting slot is disposed on said supporter, and extends along an axial direction of said driving shaft;

said supporting sleeve is disposed in said adjusting slot;

an adjusting screw is disposed at the outside of said supporter, and abuts against said supporting sleeve;

a groove is disposed at an outer surface of said supporting sleeve; and an edge at both sides of said adjusting slot is engaged with said groove.

6. The pan cleaner of claim 4, wherein at least one of said connecting portion and said roller has a vertical gear;

said roller is made of elastomer;

said roller has a convex-arc-shaped vertical section profile; and a top of said supporting shaft is a guide portion.

7. The pan cleaner of claim 4, wherein said brush sweeper comprises a brush mount and a bristle;

a guide hole is disposed on said brush mount;

said guide hole is slidingly engaged with said guide portion of said supporting shaft, so that said brush sweeper rotates along with said supporting shaft;

a spring is mounted on said supporting shaft;

said brush sweeper is elastically supported by said spring; and said brush mount is made of flexible material.

* * * * *